US005277590A

United States Patent [19]

Thomas et al.

[11] Patent Number: 5,277,590

[45] Date of Patent: Jan. 11, 1994

[54] SWIVELING ANGLED CABLE CONNECTOR

[75] Inventors: Chris Thomas, Bronx; Victor Salvador, Mamaroneck, both of N.Y.

[73] Assignee: Kings Electronics Co., Inc., Tuckahoe, N.Y.

[21] Appl. No.: 861,467

[22] Filed: Apr. 1, 1992

[51] Int. Cl.[5] ..... H01R 35/00; H01R 17/04

[52] U.S. Cl. ..... 439/20; 439/582

[58] Field of Search ..... 439/13, 20, 21, 23, 439/24, 585, 578, 14, 18, 17, 22, 25, 26, 10–12 10–19, 582, 579–581, 583, 584, 439/675

[56] References Cited

U.S. PATENT DOCUMENTS

| | | | |
|---|---|---|---|
| 2,452,168 | 10/1948 | Warren | 439/18 |
| 2,641,744 | 6/1953 | De Packh et al. | 439/18 |
| 2,813,144 | 11/1957 | Valach | 439/579 |
| 3,229,234 | 1/1966 | Lattanzi | 439/12 |
| 3,483,307 | 12/1969 | Goodman, Jr. | 439/13 |
| 3,847,463 | 11/1974 | Hayward et al. | 439/578 |
| 4,336,974 | 6/1982 | Wilson | 439/13 |
| 5,122,063 | 6/1992 | Cooper | 439/13 |

*Primary Examiner*—Gary F. Paumen

[57] ABSTRACT

An angled rotatable cable connector is described. The cable connector has a first end for attaching to a termination point of a cable, and a second end adapted to attach to a fixed panel-mounted mating connector. The first end and second end of the cable connector are supplied as sub-assemblies, mounted within a common outer body, so that, after connection, both the cable attached to the first end, and the connector, attached to the mating connector, remain free to rotate around their respective axes.

6 Claims, 1 Drawing Sheet

SWIVELING ANGLED CABLE CONNECTOR

BACKGROUND OF THE INVENTION

The invention is directed to an electrical connector for connecting electrical cables, such as coaxial, triaxial, or multiaxial cable. Oftentimes, in applications wherein a cable must be placed in electrical continuity with a mating connector on a fixed panel or bulkhead, linear space is limited due to the configuration of the electrical device, or obstructions. When linear space is so limited, it is impossible to use a straight connector to affix the cable to the panel mounted mating connector.

To avoid this problem, angled connectors were heretofore used wherein a cable was affixed to a first end of the angled connector, the said end of the connector having a center line which intersected the center line of the first end at an angle. The second end was provided with a rotatable nut so that the connector could be attached to the fixed mating connector, while remaining free to rotate around the axis thereof. With straight connectors, the ability to rotate around the fixed mate connector is sufficient to prevent the twisting of the cable. However, with angled connectors, after connections are made the cable is not free to rotate, although the cable connector itself is rotatable around the fixed mate connector. Thus, the cable can become twisted, causing damage thereto and ultimately causing a failure in electrical continuity.

SUMMARY OF THE INVENTION

In view of the foregoing, it is an object of the present invention to provide an angled cable connector for attaching a coaxial, triaxial, or multiaxial cable, to a fixed mating connector, while allowing the free rotation of both the cable connector around the mate connector, and the cable, around the axis thereof, after connection. By so constructing the inventive connector, an angled cable connector is provided wherein the cable remains free to rotate, after connection, thereby preventing the cable from kinking and twisting, preventing damage thereto.

Other objects and features of the present invention will become apparent from the following detailed description considered in conjunction with the accompanying figure. It should be specifically noted that, although only an embodiment wherein a coaxial cable is employed will be described and illustrated, the invention is equally applicable to triaxial and multiaxial cables.

BRIEF DESCRIPTION OF THE DRAWINGS

FIG. is a sectioned side view of the inventive angled connector.

DETAILED DESCRIPTION OF THE INVENTION

Figure 1:
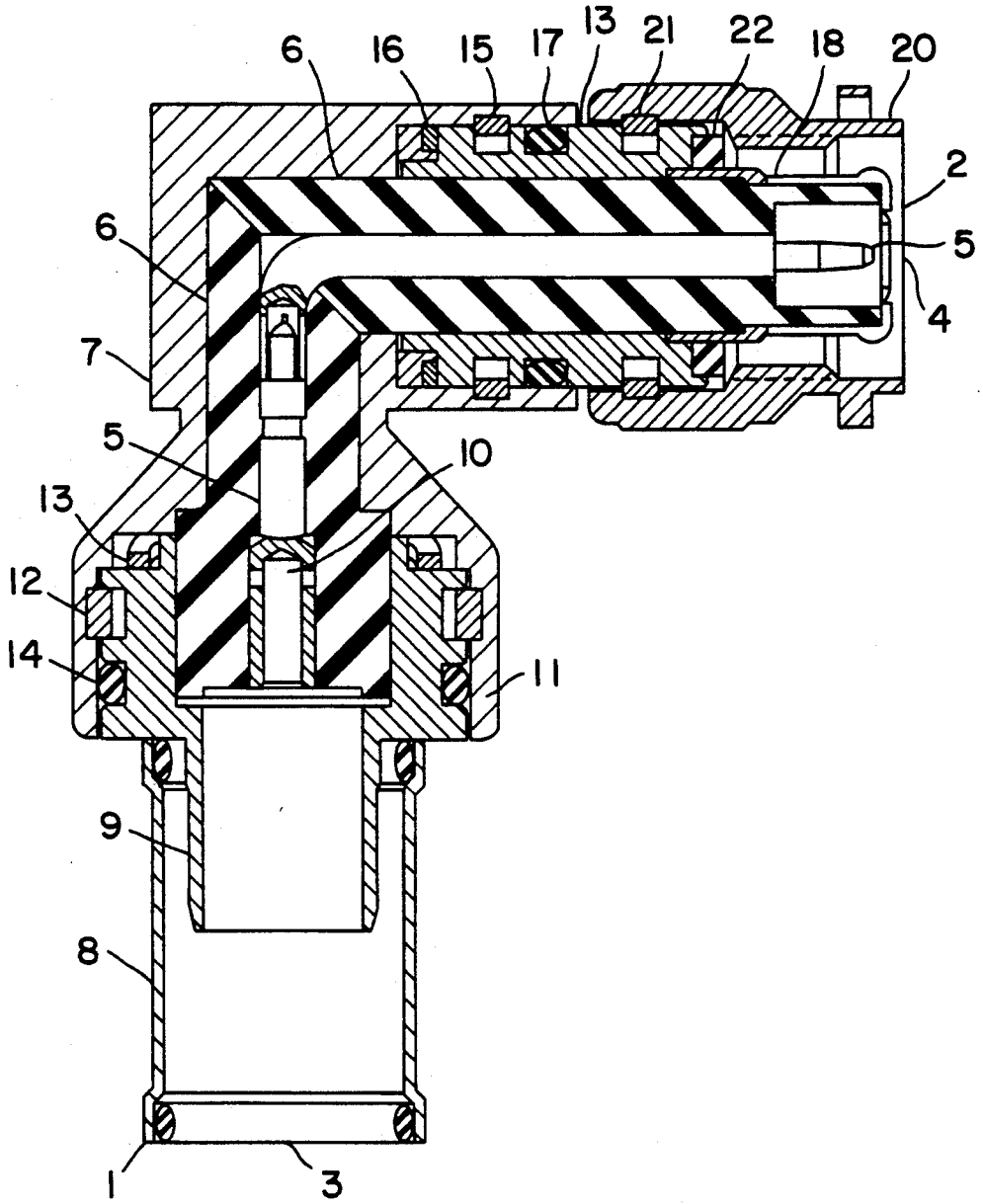

Referring now to FIG. 1, there is shown an inventive rotatable, angled coaxial connector. The inventive connector has first end 1, adapted to receive a cable, and second end 2 for engaging a fixed mating connector (not shown). Center line 3 of first end 1 intersects center line 4 of second end 2 at an angle.

Electrical continuity between first end 1 and second end 2 is provided by center contact 5 surrounded by insulator 6. Both center contact 5 and insulator 6 are, in turn, encased in outer body 7.

First end 1 comprises a subassembly which is adapted to receive a cable (not shown) and comprises sleeve 8, first core portion 9 and second core portion 10. To attach first end 1 to the cable, the cable is inserted into first end 1 so that the exposed center contact of the cable is disposed within second core portion 10, and contacts center contact 5. The cable insulator fits within first core portion 9, with the outer contact of the cable positioned around the outside thereof. After insertion of the cable, sleeve 8 is crimped to hold the cable firmly in place.

First end 1 is mounted within flanged portion 11 of outer body 7, and is held in place within flanged portion 11 by C-ring 12 Applying a force against C-ring 12 is spring washer 13. The combination of C-ring 12 and spring washer 13 securely hold first end 1 within flanged portion 11 of outer body 7, while allowing first end 1 to rotate freely. To provide a watertight seal between first end i and outer body 7, O-ring 14, made of a resilient material can be incorporated into the assembly.

Second end 2 is attached to outer body 7, in a similar manner as described with first end 1. Second end 2 comprising a subassembly including intermediate contact 18 and inner body 19 is inserted into outer body 7, and held in place by a combination of second C-ring 15 and second spring washer 16. Second O-ring 17 can also be provided to insure a moisture-proof seal between said end 2 and outer body 7. Second end 2 terminates with intermediate contact 18 and center contact 5, the combination of which, establishes electric contact with the fixed mating connector to which it is attached. (Not shown).

Attached to inner body 19 of second end 2 is coupling nut 20 adapted to screw onto the fixed mating connector to attach the inventive connector thereto. Coupling nut 20 is maintained in position around inner body 19 by third C-ring 21 which, while maintaining coupling nut 20 in position around inner body 19, allows coupling nut 20 to rotate freely. Inner gasket 22 can also be provided to further moisture-proof the assembly. The use of C-rings to hold both coupling nut 20 to inner body 19, and first end 1 and second end 2 to outer body 7, allowing both the first and second ends to remain free to rotate around center lines 3 and 4, respectively.

For practical purposes, a 90° angle is formed between first end center line 3 and second end center line 2.

The above-described connector allows free independent rotation of the perpendicular first and second connector ends. The inventive connector further provides electrical signal integrity and minimal signal noise during this rotation.

While only the fundamental novel features of the invention as applied to a preferred embodiment thereof have been shown and described, it is understood that various omissions, substitutions, and changes in the form and details of the device illustrated and in its operation, may be made by those skilled in the art without departing from the spirit of the invention. It is therefore the intention of Applicants that the invention be limited only as indicated by the scope of the claims appended hereto.

I claim:

1. An electrical connector comprising an outer body receiving a first subassembly at a first end thereof, said first subassembly being adapted to receive a cable or mating connector, and a second end receiving a second subassembly, said second subassembly being adapted to receive a cable or mating connector, electrical continuity being maintained between said first end and said second end; a center line of said second end intersecting a center line of said first end at an angle, said first subassembly and second subassembly each remaining free to independently rotate around respective center lines of said outer body and relative to said outer body after connection to said cable and mating connector.

2. The connector of claim 1 wherein said angle is 90°.

3. The connector of claim 1 wherein said mating connector is fixed.

4. The connector of claim 3 wherein said mating connector is panel mounted.

5. The connector of claim 1 wherein at least one of said cables is coaxial.

6. The connector of claim 1 wherein at least one of said cables is multiaxial.

* * * * *